US005622729A

United States Patent [19]

Mower

[11] Patent Number: 5,622,729

[45] Date of Patent: Apr. 22, 1997

[54] CORNER FINISHER TOOL FOR APPLYING MASTIC

[76] Inventor: Morris F. Mower, 1017 W. Lampton View Cir., Riverton, Utah 84065

[21] Appl. No.: 598,631

[22] Filed: Feb. 12, 1996

Related U.S. Application Data

[63] Continuation of Ser. No. 229,479, Apr. 19, 1994, abandoned.

[51] Int. Cl.[6] ..... B05C 17/10

[52] U.S. Cl. ..... 425/87; 15/235.7; 403/325; 403/328; 403/DIG. 4; 425/186; 425/458

[58] Field of Search ..... 425/87, 318, 458, 425/186; 15/235.7, 235.8; 403/122, 321, 322, 325, 328, DIG. 4

[56] References Cited

U.S. PATENT DOCUMENTS

| | | | |
|---|---|---|---|
| 2,594,606 | 4/1952 | Ames | 425/87 |
| 2,824,443 | 2/1958 | Ames | 425/87 |
| 2,889,965 | 6/1959 | Ames | 425/87 |
| 3,798,701 | 3/1974 | Irwin et al. | 15/235.8 |
| 4,504,167 | 3/1985 | Nakanishi | 403/325 |
| 4,527,925 | 7/1985 | Bauer et al. | 403/328 |
| 4,663,796 | 5/1987 | Helling et al. | 15/235.8 |
| 4,664,611 | 5/1987 | Kumar | 425/87 |
| 4,767,297 | 8/1988 | Mower et al. | 425/87 |
| 4,929,117 | 5/1990 | Yamanoi | 403/328 |
| 5,010,618 | 4/1991 | Croft | 15/235.7 |
| 5,263,836 | 11/1993 | Tinawong | 15/235.7 |

*Primary Examiner*—Jay H. Woo
*Assistant Examiner*—Joseph Leyson
*Attorney, Agent, or Firm*—Laff, Whitesel, Conte & Saret, Ltd.

[57] ABSTRACT

A corner finisher spreads mastic on a joint formed at an inside corner of drywall. The drywall corner finisher is conventionally used with a plurality of alternative tools for supplying a plurality of coats of mastic in different thicknesses. Therefore, a quick disconnect coupler is provided to rapidly change the tools and yet to hold them so securely that there is almost no chance for an unwanted disconnect between the drywall corner finisher and one of the alternative tools for supplying mastic. The invention provides such a coupler in the form of a ball and socket behind a sliding locking plate having a key hole slot in it for receiving a ball on a mastic delivery device.

13 Claims, 2 Drawing Sheets

CORNER FINISHER TOOL FOR APPLYING MASTIC

This application is a continuation of application Ser. No. 08/229,479, filed Apr. 19, 1994, now abandoned.

This invention relates to tools for applying mastic to corners of drywall, and more particularly to fail safe quick disconnect couplers for such tools.

BACKGROUND OF THE INVENTION

Currently, drywall is almost universally used for interior walls in houses and buildings. The drywall comes in large sheets which are fitted together to make a solid wall surface having an appearance approximating the appearance of a plastered wall. The cracks between the sheets must be covered by a tape and mastic which is thereafter sanded to give the plastered wall appearance.

This means that, in the interior corners of the walls, it is necessary to fit the tape and mastic properly and almost perfectly along the 90° angle between the two walls that meet in the corner. The corner finisher tool should have enough freedom of movement to enable it to position and accommodate itself to irregularities on the wall surface. The tape should not either span the corner or fit into a crack between the wallboards. The mastic should be applied as smoothly as possible because it is difficult to sand off the excess mastic in the corner. An example of a prior art corner finisher tool is found in U.S. Pat. No. 4,767,297.

Among other things, there are many different kinds of tools which may be used for applying the tape and mastic to both the flat seams on a wall surface between drywall sheets and the corners where drywall sheets abut. Three coats of mastic are applied in different thicknesses over the tape. Therefore, there are many tools which are generally parts of a mastic application system and which should be changed quickly and easily as the workman encounters different needs during his work.

Therefore, it is a common practice to provide a quick disconnect coupler for joining the various drywall mastic applicator tools to each other. However, heretofore there have been problems because there were frequent failures of the locking mechanism on the coupler, such as for securing a corner finisher tool to other equipment for supplying a mastic. In particular, it was difficult to secure a corner finishing tool to a mastic source because the finisher tended to be larger and heavier than other tools, because the need for precision in the corners is much more severe than the need for precision on a strictly flat wall surface, and because the pressure of mastic being squeezed out of a pressurized delivery system tends to push the finisher off the tool for delivering the mastic.

The prior art used a U-shaped spring, into which a tool snapped, in order to solve the simultaneous problems of providing quick disconnect and secure locking after the connection was made. The troubles were multiplied because the corner finisher tool could easily separate from the associated tools and fall to the ground. The corner finisher tool then might be damaged. While the tool itself could be replaced, if the tool fell in a bathroom, for example, the ceramic tile, a bath tub, or another fixture could be chipped or otherwise severely damaged by the falling tool. These problems are often difficult and expensive to repair.

SUMMARY OF THE INVENTION

Accordingly, an object of the invention is to provide new and improved locking means for quick disconnect means for securing tools to drywall mastic applicators. Here, an object is to provide a quick connect or disconnect means for reliably locking the tools on the applicator in a fail safe manner. In this connection, an object is to accomplish these and other objects at a cost which is almost the same as the cost of the prior art locking mechanism.

In keeping with an aspect of the invention, these and other objects are accomplished by providing a spring biased, sliding plate which has a somewhat key hole shaped slot therein. The plate is normally spring biased to cause it to slide to a position where a small end of the key hole slot is in a locking position to pass and capture a ball joint on the tool in a socket on another tool. When the plate is slid against the spring bias, the large end of the key hole slot is positioned over the ball joint so that it may be easily removed to replace one tool with another tool.

BRIEF DESCRIPTION OF THE DRAWINGS

A preferred embodiment of this invention is seen in the attached drawings, wherein.

DESCRIPTION OF THE INVENTION

Figure 1:
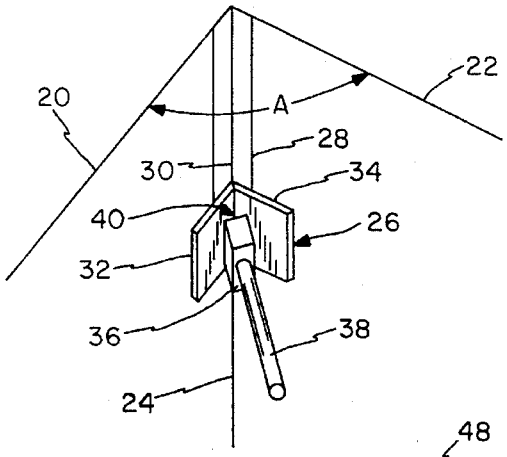
FIG. 1 schematically shows a corner finisher tool being used to apply mastic to an inside corner of a drywall.

FIG. 1 shows two large sheets of drywall 20, 22 which meet and abut at and are joined to provide an inside corner A. Most of the time, the angle A is a nominal 90°; however, buildings are not that precisely built and so there may, within reason, be a considerable variation in angle A. The object of the corner finisher tool 26 is to apply a tape 28 which covers the crack 24 between the drywall sheets and to place mastic in the corner to protect the tape and to give a plaster-like surface. Each of the longitudinal halves of the tape which are secured against walls 20, 22 should fit smoothly and cling to the wall without any wrinkles or buckles. The fold 30 should fit smoothly over the crack 24, without either spanning or fitting into the crack.

Therefore, to smooth both the tape and the mastic, corner finisher tool 26 has two converging flat plates or surfaces 32, 34 which are set at a 90° angle with respect to each other in order to fit against the two wall surfaces 20, 22. The mastic (sometimes called "mud") is applied over the tape 28 in order to strengthen the tape and to provide a plaster-like surface. To smooth the tape 28 and mastic, the handle 38 is manipulated to move tool 26 up or down the corner of the walls. The tool 26 should be able to tip and alter its posture somewhat relative to the handle 38 so that the plates 32, 34 always rest firmly against wall surfaces 20, 22 despite minor variations of the wall construction.

Figure 4:
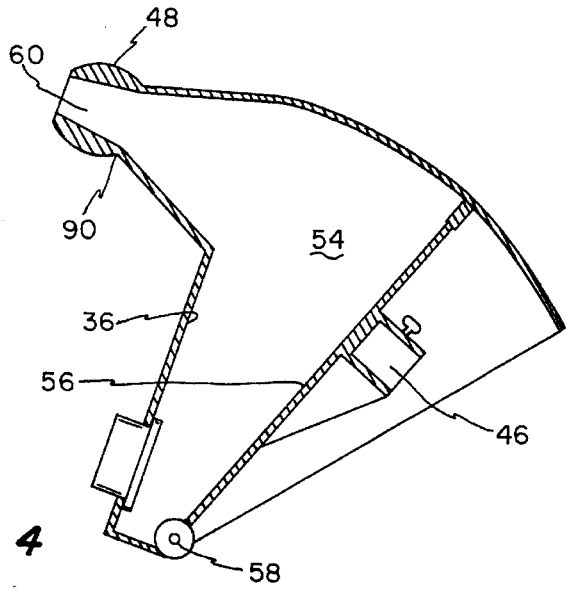
FIG. 4 is a cross section view of an exemplary mastic supply tool which may be used in combination with the tool of FIG. 2.
Figure 2:
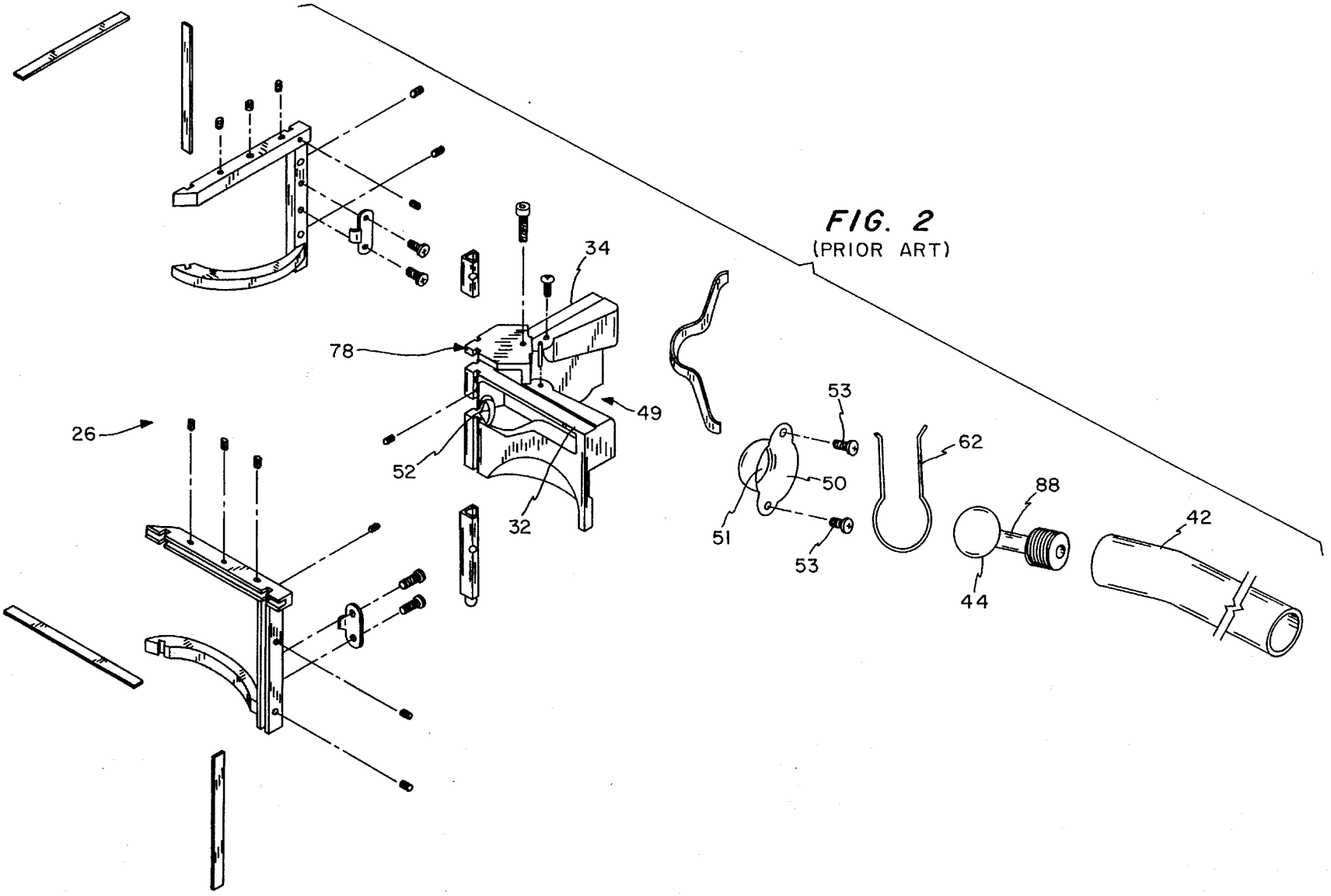
FIG. 2 (PRIOR ART)
FIG. 2 is an exploded view of a prior art corner finisher tool shown in U.S. Pat. No. 4,767,297.

As shown in FIG. 4, there is a housing 36 that contains mastic which is pressed out and on to the wall as pressure is applied by a manually manipulated pole 38. Another tool might apply the mastic through a pressurized hose and a pipe (FIG. 2). Yet another mastic smoothing tool might not deliver any mastic, relying instead upon mastic which is manually applied to the drywall by a workman wielding a trowel. Depending upon conditions that are encountered at any time, the workman may want to use any or all of these tools, even on a single joint. To accommodate all of these needs, a quick disconnect coupler 40 is provided so that the workman can switch tools quickly and easily.

Figure 5:
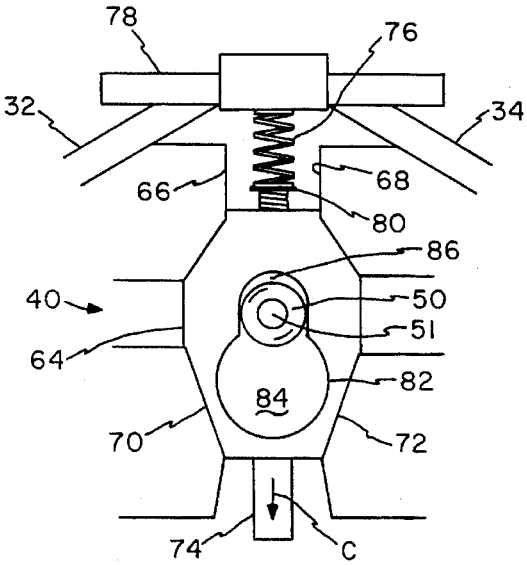
FIG. 5 is a fragment of the tool of FIG. 2 with the inventive locking mechanism in a tool locking position.
Figure 6:
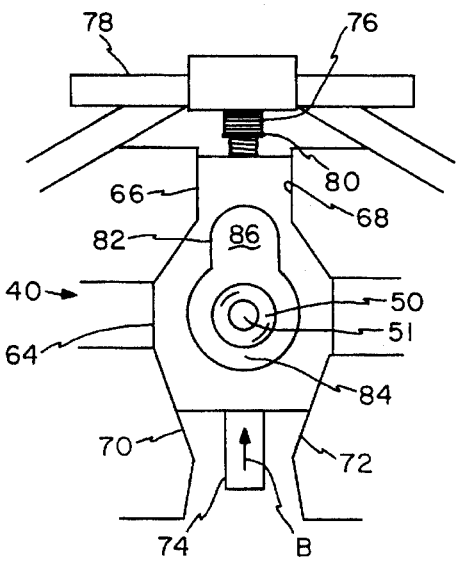
FIG. 6 is the same tool fragment that is shown in FIG. 5, but with the inventive mechanism in a tool unlocking position.

More particularly, FIG. 2 is an exploded view of a prior art corner finisher tool 26 which is adapted to use the inventive quick disconnect coupler, shown in greater detail in FIGS. 5, 6. FIG. 2 shows a pressurized hose and pipe 42 (sometimes called a "bazooka") for supplying mastic via a ball 44 of a ball and socket joint forming the quick disconnect coupler 40 of FIG. 1.

The pressure in the hose and pipe may tend to blow the corner finisher off the ball 44. FIG. 4 shows another mastic applying tool comprising a box or housing 36 defining a cavity 54 for supplying a limited amount of mastic responsive to a manually applied pressure at socket 46. The workman might want to use the bazooka 42 to apply a first and heavy coat of mastic. He might want to use the tool of FIG. 4 to apply a second and medium coat of mastic. Finally, he might want to use only a pole terminating in a ball connector in order to smooth a thin coat applied by a hand trowel.

Alternative tools may be substituted for each other. More particularly, the ball 44 (FIG. 2) or ball 48 (FIG. 4) may be substituted for each other by fitting into a socket 50 (FIG. 2) in order to provide the quick disconnect coupler 40 so that any of these or other tools may be used.

The corner finisher 26 of FIGS. 1 and 2 is shown and explained in U.S. Pat. No. 4,767,297; therefore, it will not be explained in great detail at this point. In general, socket 50 and ball 44 together constitute the quick disconnect coupler 40 by screws 52, 53. Socket 52 is firmly attached to the back of a cast aluminum head 49 by screws 52, 53. A mastic delivery hole 52 (cavity 20 in U. S. Pat. 4,767,297) is formed in the apex of the angle between converging walls 32, 34. Socket 50 has a center hole 51 which confronts and communicates mastic with hole 52 in finisher 26. Socket 50 receives a ball 44 attached to a bazooka tool 42 which is used to apply the pressurized mastic through the aligned holes 51 in socket 50 and 52 in head 49.

Usually, a first of three coats of mastic, applied to the corner, is very heavy and is supplied through a bazooka or pressurized hose and pipe 42 and ball 44. Therefore, ball 44 is locked into socket 50 and thereby connected to the corner finisher. The second coat is thinner and is applied through the housing 36 of FIG. 4. Hence, to switch corner finisher 26 from bazooka 42 to housing 36, ball 44 is first removed from the socket 50 and then ball 48 is placed in socket 50. Then, a handle 38 (FIG. 1) is secured in socket 46 (FIG. 4) so that the joined combination of box or housing 36 and corner finisher tool 26 may be held against and moved over the wall. The handle 38 applies pressure on socket 46 and swings door 56 pivoted at 58 in order to push the mastic out of a hole 60 in ball 48 at the end of box or housing 36. After that, a coating of mastic is applied to the wall via opening 60 in the tool of FIG. 4. A very thin finishing coat may be applied by a trowel and smoothed down by a finishing pass of the tool. In this, case, no mastic passes through the corner finisher 26. Therefore, the ball 48 is removed from socket 50 and a solid metal ball on the end of a handle is placed in socket 50.

Figure 3:
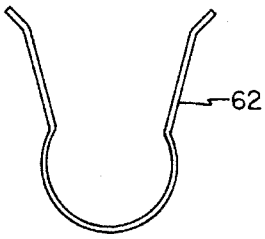
FIG. 3 (PRIOR ART)
FIG. 3 is a plan view of a prior art U-shaped spring used as a tool locking device.

Heretofore, the quick disconnect coupler (FIG. 2) included a somewhat hairpin shaped, spring clip 62 (clip 56 in U.S. Pat. No. 4,767,297). The ball 44 or 48 was simply pushed against the spring clip 62 with enough "brute force" to spread the clip (as shown in FIG. 3) with the ball passing through the spread clip and into socket 50. Or, the ball was simply pulled from the spring clip 62. As the ball passes in either direction (connect or disconnect) through spring clip 62, this "brute force" causes the clip to spread from its normal configuration shown in FIG. 2 to the spread configuration shown in FIG. 3. Regardless of the direction in which the force is applied, after the ball has completed its pass through the spring clip 62, the resilience of clip 62 returns it to its normal configuration of FIG. 2.

For any of a number of reasons, the spring clip 62 may inadvertently release the ball which could result in an extensive amount of damage, as where a falling tool may clip a bath tub. For example, over a period of time, the spring clip 62 may lose at least some of its resilience. Sometimes the tool may strike the wall, or something else, with a sufficient force to cause the ball and socket to separate.

In order to provide a quick disconnect coupler which will not accidently release the ball 44 or 48 from socket 50, the spring clip 62 is replaced by a locking plate 64 (FIGS. 5, 6) which is slidingly attached to the back of the corner finisher 26. More particularly, locking plate 64 is held behind a pair of upper and lower guide plates 66, 68 and 70, 72 which guide and secure plate 64 to the corner finisher 26. These guide plates may be bolted to the back of the cast aluminum part 49; or, the cast part 49 may be made with slides 66, 68 and 70, 72 integrally formed therein during the casting.

The locking plate 64 has a dependant actuator tab 74 which may be pushed in direction B in order to raise the plate 64 against the bias of a coiled spring 76 or released so that it is restored under the spring bias. Coiled spring 76 is positioned between the top of locking plate 64 and a cap 78 (called a "frame keeper 10" in U.S. Pat. No. 4,767,297). The locking plate 64 has an upstanding tab 80 which receives the coiled spring 76 to help stabilize the spring position. When the tab 74 is pushed, spring 76 is compressed (Fig. 6). When tab 74 is released, the resilience of compressed spring 76 restores locking plate 64 to the normal position (FIG. 5).

A somewhat key hole shaped opening 82 is formed in locking plate 64 with a relatively large release opening 84 (FIG. 5) at the bottom and a relatively small capture opening 86 (FIG. 6) at the top. When the tab 74 is pushed in direction B in order to raise the locking pate 64 against the bias of spring 76, the large release opening 84 is in front of socket 50. Ball 44 or 48 may pass freely through the opening 84 and into the socket 50. When the tab 74 is released, the bias of coiled spring 76 pushes locking plate downwardly (i.e. direction C). The small capture opening 86 passes over neck 88 (FIG. 2) or neck 90 (FIG. 4) capturing the ball 44 or 48 behind it. With the locking plate 64 so positioned (FIG. 5), the ball 44 or 48 is captured. Hence, there is no easy way that the quick disconnect coupler 40 can accidently release the ball 44 or 48 from the socket 50.

Those who are skilled in the art will readily perceive how to modify the invention. Therefore, the appended claims are to be construed to cover all equivalent structures which fall within the true scope and spirit of the invention.

The claimed invention is:

1. A corner finisher tool comprising a corner tool having two side walls with surfaces set at an angle of approximately 90° with respect to each other for applying mastic to a drywall corner, an opening at an apex formed by said two side walls for passing mastic onto said drywall corner, a socket on said corner tool confronting said opening for receiving a ball on an associated tool to be used with the corner tool for finishing a corner thereby forming a quick disconnect ball and socket coupler, said ball being on the end of a neck for delivering said mastic through a passage in said ball to and through said apex opening, said ball and socket providing a freedom for the corner tool to rotate, tip and alter its posture relative to said associated tool so that said side wall surfaces rest firmly against said drywall corner, and said corner tool having a locking plate slidably mounted over said socket, said locking plate having a key hole shaped opening formed therein with a release opening at one end communicating into a capture opening at the other end of said key hole opening, said release opening being larger than said capture opening so that said ball can pass through said release opening but not through said capture opening, said plate sliding to a first position with said release opening end of said key hole opening over said socket for said ball to pass into and out of said socket and sliding to a second position with said capture opening end of said key hole over said socket in order to capture said ball in said socket.

2. The finisher tool of claim 1 further comprising spring means for normally biasing said plate to said second position in order to capture said ball.

3. The finisher tool of claim 2 further comprising a tab on said locking plate for moving said plate against said spring means to said first position for enabling said ball to pass through said key hole opening.

4. The finisher tool of claim 3 further comprising a plurality of associated tools, each of said associated tools having a ball that fits through said release opening and into said socket, wherein said associated tools may be interchanged with each other by pushing said tab to move said locking plate to said first position.

5. The finisher tool of claim 4 wherein one of said said associated tools is taken from the class consisting of a pressurized pole for delivering mastic under pressure to said finisher, a housing containing mastic for manually delivering mastic to said finisher, and a tool free of mastic for smoothing mastic manually applied to a corner.

6. A drywall corner finisher tool comprising means including surfaces for smoothing tape and applying mastic into a corner formed by abutting drywall panels, quick disconnect means on said means for smoothing tape for enabling a substitution of any of a plurality of tool means, each tool means having a spherical ball, means for supporting a socket on said means for smoothing tape, said quick disconnect means comprising: a socket having internal contours complementary to contours of said spherical ball supported by said supporting means, whereby said ball and socket enable said tool to tip and alter its posture relative to said corresponding tool means so that said surfaces of said means for smoothing and applying mastic rest firmly against corner wall surfaces, a locking plate having a key hole defined by a release opening and a capture opening, the release opening being larger than the capture opening, said release opening communicating with said capture opening, said plate being movable to a release position which enables said ball to pass through said release opening and into or out of said socket while said plate is in said release position, said plate being movable to a capture position with said capture opening in a location which prevents said ball from passing out of said socket while said plate is in said capture position; and means for moving said locking plate to said release position, and means for automatically returning said locking plate from said release position to said capture position.

7. The finisher tool of claim 6 wherein said means for smoothing tape and applying mastic has a mastic opening through which mastic may pass, said mastic opening confronting said socket, said locking plate being slidably mounting behind said socket to move said locking plate between said capture and release positions, and said means for automatically returning said locking plate comprises a spring for normally urging said plate to said capture position.

8. A drywall corner finisher tool for applying at least a mastic material along a corner wall joint, said finisher tool comprising two converging side walls joined together along an apex of said converging side walls wherein during use said two converging side walls fit against two drywall panels forming an inside corner, a mastic opening in said converging side walls to enable mastic material to pass through said opening and onto said drywall corner, a socket over said opening and behind said converging side walls, guide means on a rear side of said converging side walls and adjacent said opening for movably securing a locking plate to said finishing tool behind said socket while enabling said locking plate to pass over said opening while said locking plate remains secured to said finisher tool, said locking plate having contour means which embrace and capture a spherical ball within said socket responsive to one instantaneous position of said plate or for releasing said spherical ball in said socket responsive to another instantaneous position of said plate, whereby said tool may tip and alter its posture, so that said tool always rests firmly against corner wall surfaces, wherein said means responsive to the instantaneous position of said plate comprises an opening shaped to receive said ball when said plate is moved into said one position and to capture said ball when said plate is moved into said other position.

9. The finisher tool of claim 8 wherein said means responsive to the instataneous position of said plate comprises an opening in said locking plate having a relatively large dimension for enabling said ball to pass through and into said socket when said locking plate is in said one position and a relatively small dimension for preventing said ball from leaving said socket when said locking plate is in said other position.

10. The finisher tool of claim 9 wherein said opening has a key hole shape.

11. The finisher tool of claim 10 further comprising a housing for receiving said mastic, a ball on said housing, an opening in said ball on said housing, a door pivotally mounted in said housing for pushing mastic out of said opening in the ball on said housing, and said ball having dimensions that fit said socket.

12. The finisher tool of claim 10 further comprising a mastic delivery system comprising a pressurized hose and pipe terminating in a ball having dimensions which fit into said socket, said hose and pipe enabling a transmission of mastic through a hole in said ball and socket and through said opening in said converging side walls.

13. A corner finisher tool for use with an associated mastic-delivery tool having a neck shaped end including a ball, said corner finisher tool comprising:

two side walls with surfaces intersecting at an apex and an opening at said mastic for passing mastic there through;

a socket confronting said opening for receiving said ball of said neck shaped end including said ball of said associated tool, said socket having an internal contour for matingly engaging said ball;

a locking plate having a key hole defined by a release opening and a capture opening, the release opening being larger than the capture opening, said release opening communicating with said capture opening, said plate being movable to a release position which enables said ball and neck shaped end of said associated tool to pass through said release opening and into said socket while said plate is in said release position, said plate being movable to a capture position with said capture opening in a location which prevents said ball from passing out of said socket while said plate is in said capture position; and means for moving said locking plate to said release position, and means for automatically returning said locking plate from said release position to said capture position, whereby said ball and socket enables said corner finisher tool to tip and alter its posture relative to said associated tool so that said side wall surfaces rest firmly against a desired drywall corner.

* * * * *

UNITED STATES PATENT AND TRADEMARK OFFICE

CERTIFICATE OF CORRECTION

PATENT NO. : 5,622,729

DATED : April 22, 1997

INVENTOR(S) : Morris F. Mower

It is certified that error appears in the above-identified patent and that said Letters Patent is hereby corrected as shown below:

On the title page item [73], should read

-- [73] Axia Incorporated
2001 Spring Road --
Oak Brook, Illinois 60521

Signed and Sealed this

Seventh Day of April, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,622,729
DATED : April 22, 1997
INVENTOR(S) : Morris F. Mower

It is certified that error appears in the above-identified patent and that said Letters Patent is hereby corrected as shown below:

Column 6,
Lines 34 and 41, delete “one” and replace with -- another --.
Lines 36 and 44, delete “other” and replace with -- one --.

Signed and Sealed this

Twenty-first Day of September, 2004

JON W. DUDAS
*Director of the United States Patent and Trademark Office*